US008235517B2

(12) United States Patent
Grant et al.

(10) Patent No.: US 8,235,517 B2
(45) Date of Patent: Aug. 7, 2012

(54) PRINTING PROCESS

(75) Inventors: Alexander Grant, Bath (GB); Nigel Anthony Caiger, Wookey Hole (GB); Derek Edward Wilson, Wells (GB)

(73) Assignee: Sun Chemical Corporation, Parsipanny, NJ (US)

( * ) Notice: Subject to any disclaimer, the term of this patent is extended or adjusted under 35 U.S.C. 154(b) by 907 days.

(21) Appl. No.: 11/718,061

(22) PCT Filed: Oct. 27, 2005

(86) PCT No.: PCT/GB2005/004178

§ 371 (c)(1), (2), (4) Date: Dec. 12, 2008

(87) PCT Pub. No.: WO2006/046061

PCT Pub. Date: May 4, 2006

(65) Prior Publication Data

US 2009/0153634 A1 Jun. 18, 2009

(30) Foreign Application Priority Data

Oct. 27, 2004 (GB) ..... 0423863.0

(51) Int. Cl.
*B41J 2/01* (2006.01)

(52) U.S. Cl. ..... 347/102

(58) Field of Classification Search ..... 428/195.1, 428/211.1; 347/102
See application file for complete search history.

(56) References Cited

U.S. PATENT DOCUMENTS

| | | | | |
|---|---|---|---|---|
| 4,484,948 | A * | 11/1984 | Merritt et al. | 106/31.3 |
| 5,959,020 | A * | 9/1999 | Oliveri et al. | 524/487 |
| 5,997,136 | A * | 12/1999 | Fujisawa et al. | 347/101 |
| 6,328,408 | B1 * | 12/2001 | Gelbart | 347/20 |
| 6,357,871 | B1 * | 3/2002 | Ashida et al. | 347/106 |
| 7,559,639 | B2 * | 7/2009 | Belelie et al. | 347/100 |
| 2003/0021961 | A1 * | 1/2003 | Ylitalo et al. | 428/195 |
| 2005/0088508 | A1 * | 4/2005 | Iwasaki et al. | 347/213 |
| 2008/0058207 | A1 * | 3/2008 | Ohga | 503/225 |

FOREIGN PATENT DOCUMENTS

WO 97/47480 A 12/1997

* cited by examiner

*Primary Examiner* — Charlie Peng
(74) *Attorney, Agent, or Firm* — McKenna, Long and Aldridge, LLP.

(57) ABSTRACT

The invention relates to an ink jet printing process which comprises the steps of i) applying a radiation-curable primer to a substrate to form a layer of primer, ii) ink jet printing a radiation-curable ink onto the primer layer, and iii) curing the primer and the ink, wherein the viscosity of the primer increases rapidly after application to the substrate.

19 Claims, No Drawings

PRINTING PROCESS

CROSS REFERENCE TO RELATED APPLICATIONS

This application is the United States national stage filing of corresponding international application number PCT/GB2005/004178 filed on Oct. 27, 2005 which claims priority to and benefit of Great Britain application number 0423863.0, filed Oct. 27, 2004, each of which is hereby incorporated herein by reference.

The present invention relates to a printing process, in particular, to an ink jet printing process, to a primer composition for use in the process and to printed articles made using the process.

Radiation-curing ink jet printing has become a commercially accepted technology for producing graphic display and other products on a wide range of substrates, such as paper, cardboard, plastics and glass. The advantages of ink jet printing include being able to print direct from a computer, being able to economically print small print runs, being able to easily customise individual images, minimal down time between jobs and the robust performance of the printed product.

The quality of ink jet printed images will vary from substrate to substrate. For example, an ink jet printer printing the same image using the same inks onto a range of different cardboards will tend to give image qualities which vary from the acceptable to the very poor. One problem is that when the substrate is particularly porous the ink droplets may be completely absorbed into the substrate before the ink is cured, thereby preventing the formation of a film of ink on the surface of the substrate. Images produced in such circumstances tend to have low colour strength.

On the other hand, if the surface of the substrate is such that the ink droplets do not absorb into it or spread across it in the interval between impact of the droplets with the substrate and curing of the droplets, then the ink does not form a film either but is instead present as rows of droplets, which show up in the image as narrow lines extending in the direction of travel of the substrate through the printer.

One possible approach to overcoming those problems would be to use a different range of jet inks for each substrate, each range being tailored to the requirements of a particular substrate. However, that approach would require the printer to stock many ranges of jet ink and would also require a lengthy and costly changeover of inks whenever it was desired to change the substrate being printed on by a particular printer.

An alternative approach would be to print only onto substrates which have been coated with coatings which render those substrates well suited to ink jet printing. However, such coated substrates are expensive and may not be widely available or economic to transport from the manufacturer to where the printing is carried out. For example, suitably coated corrugated cardboards are few in number, are expensive and are costly to transport relative to their value.

Accordingly, there is a need for an ink jet printing process which produces images of acceptable quality using the same range of inks on a variety of different substrates.

The present invention provides a process of ink jet printing which comprises the steps of i) applying a radiation-curable primer to a substrate to form a layer of primer ii) ink jet printing a radiation-curable ink onto the layer of primer, and curing the primer and the ink, wherein the viscosity of the primer increases after application to the substrate.

Thus, according to the invention, a cardboard box, for example, may be printed by a process in which the cardboard blank is taken from a stack, a layer of primer is applied to the blank, for example, using a roller, the primed blank is passed under the print head and an image is printed onto the primer layer and then both the primer and ink are cured simultaneously by subjecting them to radiation.

Because the ink is printed onto the top of the primer layer and does not come directly into contact with the substrate itself, the variation in print quality from substrate to substrate is significantly reduced, thereby allowing the printer to print a wider range of substrates without needing to change the inks.

Whilst processes in which the primer and the ink are cured in separate stages and/or by different types of radiation, for example, one by UV-curing and the other by electron beam are within the scope of the invention, it is preferred for reasons of simplicity and economy for the primer and the ink to be cured simultaneously, that is, in the same step by the same radiation source. For example, where the ink is a UV-curing jet ink the primer is advantageously also UV-curable and can be cured by exposure to the same dose of radiation which is used to cure the ink.

The term "radiation-curable" as used herein means that curing is induced by one or more types of radiation, such as UV-light or electron beam (EB) radiation. In one embodiment, the primer is UV-curable and the process of the invention involves curing the primer by exposure to UV-light. UV-curable primers will, in general, comprise a photoinitiator, which may be a cationic photoinitiator or a free radical photoinitiator, as explained further below. In another embodiment, the primer is EB-curable and the process of the invention involves curing the primer by exposure to an electron beam. EB-curable primers do not require a photoinitiator, although one or more may be present.

Typically, the viscosity of the primer increases rapidly after application to the substrate. A rapid increase in viscosity is advantageous in facilitating printing of the ink onto the primer shortly after application of the primer to the substrate. The increase in viscosity preferably occurs during the timescale of an on-line printing process. The increase in viscosity may occur in less than 1 minute, preferably less than 10 seconds and in some applications in less than 2 seconds, for example in less than 1 second.

The primer may be 100% solids i.e. containing essentially no volatile component such as water or organic solvents, or it may be a water or solvent diluted material. The primer will contain at least one component that can be cured by a radiation-induced reaction. The radiation-curable components may be oligomeric or polymeric materials of relatively high molecular weight and/or are monomers having a relatively low number average molecular weight of less than 1000. The monomers may be monofunctional or multifunctional (that is, having more than one polymerisable group). Advantageously, the primer includes both monofunctional and multifunctional monomers. The skilled person will be aware that certain materials, particularly certain photoinitiators which are used in the inks, cause yellowing. Preferably the primer composition does not comprise any such yellowing component.

The radiation-curable component or components may be present in an amount of from 5% to 95% by weight, preferably from 10% to 90% by weight and more preferably from 30% to 70% by weight, based on the total weight of the primer.

Two suitable types of curing reaction which are well known in the ink jet and other fields are free-radical curing and cationic curing. Suitable free-radically curable components include ethylenically unsaturated monomers and oligomers such as acrylate and methacrylate monomers and oligomers, and vinyl components such as N-vinyl pyrolidone, N-vinyl caprolactam, vinyl ethers and styrenes.

Acrylate monomers include multifunctional acrylate monomers such as hexanediol diacrylate, trimethylolpropane triacrylate, pentaerythritol triacrylate, polyethyleneglycol diacrylates (for example, tetraethyleneglycol diacrylate), dipropyleneglycol diacrylate, tri(propylene glycol)triacrylate, neopentylglycol diacrylate, bis(pentaerythritol)hexaacrylate, and the acrylate esters of ethoxylated or propoxylated glycols and polyols, for example, propoxylated neopentyl glycol diacrylate, ethoxylated trimethylolpropane triacrylate. Monofunctional acrylate monomers may be present such as the esters of acrylic acid, for example octyl acrylate, decyl acrylate, isobornyl acrylate, phenoxyethyl acrylate, tetrahydrofuryl acrylate, 2-(2-ethoxyethoxy)ethylacrylate.

Methacrylate monomers include hexanediol dimethacrylate, trimethylolpropane trimacrylate, triethyleneglycol dimethacrylate, diethyleneglycol dimethacylate, ethyleneglycol dimethacrylate, 1,4-butanediol dimethacrylate.

Vinyl ether compounds include α,β-unsaturated ether monomers, such as triethylene glycol divinyl ether, diethylene glycol divinyl ether, 1,4-cyclohexanedimethanol divinyl ether and ethylene glycol monovinyl ether, as well as ethyl-1 propenyl ether, triethyleneglycol methyl propenyl ether, triethyleneglycol methyl vinyl ether and 2-cyclopenten-1-yl ether.

Suitable cationically curable components include oxygen-containing ring opening monomers and oligomers such as those comprising an oxetane ring or an oxirane ring. Oxirane species include cycloaliphatic oxiranes (also known as epoxides), such as 3,4-epoxy cyclohexyl methyl-3,4-epoxy cyclohexyl carboxylate and the glycidyl ethers of polyols. Oxiranes derived by the epoxidation of unsaturated materials may also be suitable, for example, epoxidised soybean oil, epoxidised polybutadiene or epoxidised alkenes.

Oxetane species include mono-functional and multi-functional oxetanes, for example, 3-ethyl-3-hydroxymethyl-oxetane, bis[(1-ethyl-3-oxetanyl)methyl]ether, 3-ethyl-3-[2-ethylhexyloxy)methyl]oxetane, [1,4-bis(3-ethyl-3-oxetanylmethoxy)methyl]benzene and trimethylolpropane oxetane. Many further suitable materials are known to the skilled person.

In general, the primer and substrate should be such that the primer wets the substrate sufficiently well to form a film on the substrate when applied by the chosen method of application, and the primer should not have a viscosity so low that it is entirely drawn into the pores of porous substrates in the interval between application of the primer to the substrate and curing of the primer, although it may be advantageous for reasons of adhesion if the primer is drawn into the pores of the substrate to a limited extent.

The process conditions and the primer are such that the viscosity of the primer increases and typically increases rapidly after application to the substrate, thereby advantageously facilitating application of the primer to the substrate and also inhibiting subsequent movement of the primer into the pores of the substrate. The increase in viscosity is a significant and preferably a detectable increase, for example an increase of at least 20 mPas and preferably an increase of at least 50 mPas, more preferably at least 100 mPas and in some cases at least 500 mPas. The viscosity of the primer is preferably less than 500 mPas and advantageously no greater than 100 mPas, more preferably no greater than 70 mPas and especially no greater than 50 mPas on application to the substrate. Having been applied to the substrate, the viscosity of the primer then increases typically prior to the printing of the ink onto the primer layer. Advantageously, the viscosity of the primer in the primer layer immediately before the ink jet printing of the radiation-curable ink is at least 100 mPas, preferably at least 500 mPas and advantageously greater than 1000 mPas. Such a viscosity change may be triggered by, for example, a reduction in temperature of the primer on application to the substrate. In particular, the primer may be heated prior to application to the substrate so that when in contact with the substrate it cools rapidly, resulting in an increase in its viscosity. The primer may be heated to a temperature higher than 40° C., optionally higher than 60° C., prior to application to the substrate.

The requirements for primer compositions which rapidly increase in viscosity upon cooling are in some ways similar to the requirements for hot melt jet inks (although the viscosity of the primer at elevated temperature need not be as low as the viscosity of a hot melt jet ink is required to be because there is no need to apply the primer by an ink jet method) and it will be within the ability of the person skilled in the art of jet inks to arrive at suitable primer compositions. The primer composition may contain a wax. The primer may be applied to the substrate at a temperature of approximately 70 to 125° C., the primer having a viscosity below 50 mPas when applied, the primer then cooling and the viscosity then increasing to at least 100 mPas, for example greater than 1000 mPas, prior to the printing of the ink jet ink.

As shown in the examples below, a primer including a wax when applied hot to the substrate has been found to give excellent results. It is believed that the wax is in a liquid state at the temperature of application of the primer but solidifies following cooling of the primer on contact with the substrate, thereby contributing to a rapid increase in viscosity. Preferably, the primer comprises in the range of from 2 to 10%, more preferably from 5 to 8% by weight of a wax based on the weight of the primer. Suitable waxes include stearic acid, lauric acid, linear polyethylene, behenic acid, stearone, carnauba waxes, microcrystalline waxes, paraffin waxes, polyethylene waxes, candelilla waxes, montan waxes, Fischer-Tropsch waxes, bisamide waxes, amide waxes, hydrogenated castor oil, synthetic ester waxes, oxidized polyethylene waxes, oleamides, stearamides, lauramides, erucamides, glycerol esters, chlorinated waxes, urethane modified waxes, and other synthetic and natural waxes. Preferably, the wax is a microcrystalline wax, an alcohol wax, an ester wax, an ethoxylated wax or an amide wax. Other approaches to providing the desired increase in viscosity of the primer following application to the substrate include having water present in the primer; the water soaking into the substrate on contact with the substrate thereby causing an increase in the viscosity of the primer. The primer may be an oil-in-water emulsion. Alternatively, for example where the substrate is not porous, the water may be lost to the atmosphere by evaporation. The water content of an emulsion primer may be such that the viscosity is above 50 mPas when applied to the substrate, the primer then loosing water to the atmosphere so that the viscosity rises to at least 100 mPas prior to the printing of the ink jet ink.

Advantageously, the primer contains no more than 75%, preferably no more than 50% water.

Although it may not always be possible for the viscosity of the primer to be directly measured after it is applied to the substrate, it is within the capabilities of the person skilled in the art to devise a method of deducing to reasonable degree of accuracy the viscosities of the primer on application and immediately prior to printing. For example, the viscosity of a bulk quantity of a primer having a hot melt ink-like constitution can be measured at the temperature at which it would be applied to a substrate in a printing head or other application method. The viscosity of the same bulk quantity of primer can also be measured at the temperature (for example 25° C.) to which the primer would cool before the ink is printed in a given process. Thus, the viscosity of the primer when applied and immediately before the ink jet ink is printed onto the primer can be easily deduced. In an alternative example, the viscosities of a bulk quantity of a water-containing emulsion primer can be measured at various water contents. The substrate can be weighed after application of a known quantity of primer having a known water content and again immediately before the printing of the ink jet ink onto the primer. The measured weight loss can be used to calculate water lost by evaporation and therefore the water content of the primer immediately before printing, thereby enabling the viscosity to be deduced. When the substrate is porous, some of the water may additionally be drawn into the substrate, which will also contribute to the increase in the viscosity of the layer of the primer left on the surface.

In most cases, the primer will be colourless and transparent. However, in some cases it may be desirable to mask the colour of the substrate or provide a background colour for printing on by including in the primer a colourant such as a pigment or dye.

Advantageously, the primer will be substantially free of volatile organic compounds, that is, organic compounds which evaporate from the primer, (although evaporable organic compounds which take part in the curing reaction to give involatile products are acceptable and are not regarded as volatile organic compounds, as that term is used herein). For example, the primer advantageously comprises less than 10%, preferably less than 5% and more preferably less than 2% by weight of volatile organic compounds.

The substrate may be any surface on which it is desired to print, for example, paper, cardboard, glass, metal or polymeric materials such as polyvinyl chloride or acrylate polymer sheets, polymeric films e.g. polyethylene, polypropylene, polyester or laminate structures. The process of the invention is particularly useful for printing on porous substrates, such as uncoated paper and cardboard, for example, corrugated cardboard of the type commonly used for manufacture of boxes, such as boxes for wine. The printing of such boxes presents particular problems because it is not economic to transport the cardboard for the boxes over long distances and therefore printing companies tend to use locally sourced cardboard which varies significantly from place to place in characteristics such as porosity. The process of the invention, which in effect allows the effect of such differences in substrates on the quality of the printed image to be reduced, is of particular value in that market. Paper and folding carton board are also preferred substrates.

The primer is preferably applied to the substrate in-line, that is, as part of the printing process. Such in-line processing is made possible in the process of the invention by the fact that there is no need to dry the primed substrate before printing so that printing can take place almost immediately after the primer has been applied. This contrasts with known primer systems in which the primer must be dried after application and before printing, which entails extra process complexity, a need for storage space and delay.

In a favoured embodiment, the primer is applied to the substrate immediately before the substrate is carried into the print head of the printer. Advantageously, the substrate is cleaned of dust, for example by a jet of air, prior to application of the primer.

The primer may be applied to the substrate by any suitable means, for example, by a brush, a roller, a knife or by spraying or any traditional printing technique. The method of application will desirably be chosen to suit the physical characteristics of the primer, for example, the viscosity of the primer. Conversely, a primer having particular characteristics may be selected for its suitability for application using a preferred method, for example ink jet printing. Advantageously, the primer is suitable for application to the substrate using an ink jet printing process. Advantageously, the viscosity is less than 500 mPas. Primers that have a relatively low viscosity when being printed (that is of less than 100 mPas and in particular less than 50 mPas) are particularly suited to application to a substrate by an ink jet printing technique.

The primer may be applied to form a layer of any suitable thickness. The primer layer may have a thickness, for example, in the range of from 1 μm to 15 μm, preferably from 1 μm to 5 μm.

As mentioned above, the primer composition and the ink will desirably be such that the ink droplets spread on the surface of the primer layer and coalesce to form a film. Advantageously, in the interval between printing of the ink onto the primer and curing of the ink and primer, a limited degree of mixing of the ink and the primer takes place. Such mixing is not in any way essential but where it takes place it may serve to enhance the adhesion of the cured ink film to the primer layer.

The invention also provides a radiation-curable primer composition for use in the method of the invention comprising at least one radiation-curable component. The primer composition may comprise at least one photoinitiator. The primer composition may comprise a colourant such as a dye or a pigment. The primer composition may comprise a wax, for example, the primer composition may comprise in the range of from 5 to 10% by weight of one or more waxes. The primer composition may be an emulsion comprising up to 75% and preferably less than 50% water by weight.

The invention also provides a printed article comprising a substrate having on at least one surface a layer of cured primer being the cured product of a radiation-curable primer and, on the layer of cured primer, an image formed of cured jet ink. The layer of cured primer composition is desirably in the range of from 1 μm to 15 μm thick. The layer of cured primer may, where it contacts the cured ink, be intermingled to a degree with that cured ink. The substrate may be a porous substrate and the cured primer composition may extend to some extent into the pores. The cured primer layer may comprise acrylate and/or methacrylate polymers, or copolymers. The cured primer layer may comprise polyether polymers or copolymers. The printed article may be a cardboard box or a blank for a cardboard box, especially a box made of corrugated cardboard.

Examples of the invention will now be described for the purpose of illustration only.

EXPERIMENTAL

Primers

Two primers were used as follows:

ILC1-27-1—a wax-containing UV curable primer having the composition shown in table 1. This was applied to the substrate at 70° C. and then allowed to cool to room temperature in air.

TABLE 1

Composition of a wax-containing primer ILC1-27-1

| Trade Name | Name | Type | Supplier | Parts by weight |
|---|---|---|---|---|
| Sartomer 9003 | propoxylated neopentyl glycol diacrylate | monomer | Sartomer | 55.9 |
| Lucerin TPO | | photoinitiator | BASF | 4.9 |
| Sartomer 399 | 2-phenoxyethylacrylate | monomer | Sartomer | 23 |
| Trigonal 12 | 4-phenylbenzophenone | photoinitiator | Akzo Chemie | 2 |
| Speedcure ITX | 2-isopropylthioxanthone | photoinitiator | Lambson Chemicals | 1.5 |
| Irgacure 369 | ketone photoinitiator | photoinitiator | Ciba | 0.5 |
| Speedcure EDB | ethyl 4-imethylamino benzoate | photoinitiator | Lambson Chemicals | 2 |
| Megaface F479 | | surfactant | DIC | 0.2 |
| Syncrowax ERL | hydrocarbon | wax | Croda | 10 |

Emulsion primer—a water-based UV curable primer comprising 95.24% by weight of Neorad QC526A, a urethane acrylate oligomer emulsion available from Neoresins and 4.76% by weight Irgacure 500, a photoinitiator. The total water content of the primer was 57% by weight.

The primers were applied to the substrate by coating with a 4 μm wire-wound coat bar.

Ink

The ink used was UV curable jet ink A comprising, inter alia, 84.62% by weight of acrylate monomers, 0.2% by weight of polyether modified polysiloxane surfactant, 2.25% by weight pigment blue 15:4 and 1.8% Irgacure 369 as photoinitiator.

Substrates

The following substrates were used:

SCA Easyadd white liner paper;

Brown Kraft paper;

Kappa Brown, Kappa White and Kappa Grey papers; and

Various liner papers commercially available in different regions of Europe.

Contact Angles

Contact angles were measured at various times after impact of the ink droplet on the primed or unprimed substrates as shown in the tables. A Fibrodat instrument was used. The droplet volume was 3.9 microliters, using tubing of 0.2 mm internal diameter.

Printing

A Spectra Nova 256 print head was used at a temperature of 45° C. The drop mass was 70 ng. Prints were made onto primed (uncured) or unprimed substrate and were then UV cured at a dose of 400 mJ/cm$^2$.

Image Quality

Image quality was assessed using a QEA apparatus according to the ISO 13660 procedure to give the line width of a printed line. All line width were measured at 2 seconds print to cure time.

EXAMPLE 1

Wax-Containing UV Curable Primer in Combination with UV Curable Jet Ink A on SCA Easyadd Paper The UV curable wax-containing primer, ILC1-27-1, was applied at 70° C. to SCA Easyadd as an 4 μm thick film and allowed to cool in air to room temperature. Contact angles were then measured using the Fibrodat apparatus and the UV curable jet ink A. Jet ink A was then printed into the primed substrate and cured. Comparison measurements of contact angle and print quality were carried out on unprimed SCA Easyadd paper.

The results are shown in table 2.

TABLE 2

Contact angle and print quality results on primed and unprimed SCA Easyadd paper.

| Time | Unprimed | Primed |
|---|---|---|
| | Contact Angle (°) | |
| 0.2 second | 37.4 | 61.9 |
| 1.0 second | 18.6 | 28.6 |
| 2.0 seconds | <15 | 24.1 |
| | Line width (μm) | |
| | 322.47 | 95.21 |

The results in table 2 show a clear difference in ink wetting properties for the primed and unprimed paper. The high contact angle values obtained for the primed paper are indicative of a low level of spreading, which is reflected in the corresponding printed line width. Scanning electron microscopy of the printed samples confirmed that the primed paper had a much smoother and more even surface than the unprimed substrate and that the line of droplets printed onto the unprimed substrate had spread to form a single blurred line whereas on the primed substrate the ink had spread to a much lesser extent and remained in the form of discrete droplets.

EXAMPLE 2

Wax-Containing UV Curable Primer in Combination with UV Curable Jet Ink A on Various European Papers The ILC1-27-1 primer was applied to various coated, semi-coated or uncoated papers available commercially in different European countries. The results are shown in table 3.

TABLE 3

Results for various European papers primed with ILC1-27-1 primer and unprimed.

| | UK | | Sweden | | Austria | | | Italy | | | Finland | |
|---|---|---|---|---|---|---|---|---|---|---|---|---|
| White | Contact Angle (°) | | Contact Angle (°) | | Contact Angle (°) | | White | Contact Angle (°) | | White | Contact Angle (°) | |
| uncoated | unprimed | primed | unprimed | primed | unprimed | primed | semi-coated | unprimed | primed | uncoated | unprimed | primed |
| 0.2 second | 32 | 59.8 | 31.2 | 52.8 | 33.4 | 52.1 | 0.2 second | 34.4 | 60.6 | 0.2 second | 28.7 | 55.9 |
| 1 second | <17.3 | 56.2 | 16.5 | 49 | <18.2 | 49.1 | 1 second | 20.3 | 51.6 | 1 second | <19 | 51.7 |
| 2 seconds | — | 55 | — | 47.4 | — | 48.1 | 2 seconds | 17.4 | 48.6 | 2 seconds | — | 50.2 |
| Line Width (μm) | 265.36 | 105.28 | 323.74 | 96.23 | 235.69 | 123.04 | Line Width (μm) | 312.72 | 127.43 | Line Width (μm) | 284.29 | 109.15 |
| White | Contact Angle (°) | | Contact Angle (°) | | Contact Angle (°) | | | Contact Angle (°) | | White | Contact Angle (°) | |
| semi-coated | unprimed | primed | unprimed | primed | unprimed | primed | Brown Kraft | unprimed | primed | coated | unprimed | primed |
| 0.2 second | 32.4 | 54.4 | 30.6 | 58.1 | 32.4 | 59.8 | 0.2 second | 34.1 | 59.6 | 0.2 second | 27.9 | 44.8 |
| 1 second | 15.7 | 51.2 | <15.6 | 52.6 | <16.4 | 54.4 | 1 second | 18.3 | 50.2 | 1 second | <15.7 | 44.1 |
| 2 seconds | — | 49.9 | — | 50.9 | — | 51.9 | 2 seconds | — | 47.5 | 2 seconds | — | 43.4 |
| Line Width (μm) | 325.63 | 104.04 | 331.71 | 95.27 | 304.37 | 131.18 | Line Width (μm) | 330.01 | 129.44 | Line Width (μm) | 182.65 | 107.67 |
| White | Contact Angle (°) | | Contact Angle (°) | | Contact Angle (°) | | | Contact Angle (°) | | White | Contact Angle (°) | |
| coated | unprimed | primed | unprimed | primed | unprimed | primed | QC paper | unprimed | primed | coated | unprimed | primed |
| 0.2 second | 31.3 | 53.6 | 29.1 | 48.9 | 28.2 | 43.7 | 0.2 second | 33.4 | 54.8 | 0.2 second | 27.1 | 46.2 |
| 1 second | 16.7 | 47.1 | 17.5 | 46.8 | 16.9 | 40.4 | 1 second | 18.7 | 46.8 | 1 second | 15.1 | 45.2 |
| 2 seconds | — | 46.5 | 14.2 | 46.1 | 16 | 40 | 2 seconds | — | 44.3 | 2 seconds | — | 44.6 |
| Line Width (μm) | 167.52 | 110.43 | 188.66 | 91.82 | 160.1 | 97.21 | Line Width (μm) | 304.19 | 121.33 | Line Width (μm) | 184.58 | 99.77 |

In each case the line width results show more consistency across a variety of substrates for the primed substrates, as compared to the unprimed substrates.

EXAMPLE 3

Emulsion UV Curable Primer and in Combination with UV Curable Jet Ink A on Various Papers The emulsion UV curable primer was applied to separate samples of a range of papers. Contact angle and line width results for the primed and unprimed substrates are shown in table 4.

TABLE 4

Contact angles and line width results for a variety of papers, unprimed, and primed with the emulsion UV curable primer.

| | Kappa Brown paper Contact Angle (°) | | Kappa White paper Contact Angle (°) | | Kappa Grey paper Contact Angle (°) | | SCA Easyadd paper Contact Angle (°) | |
|---|---|---|---|---|---|---|---|---|
| | Unprimed | Emulsion primer | Unprimed | Emulsion primer | Unprimed | Emulsion primer | Unprimed | Emulsion primer |
| 0.2 second | 40.2 | 36.9 | 29.3 | 38 | 29.2 | 29.9 | 34 | 42 |
| 1 second | 26.6 | 26.2 | 19.5 | 26.8 | 18.4 | 19.1 | <20 | 31 |
| 2 seconds | 22.2 | 22.7 | <19.5 | 23.1 | <18.4 | <19.1 | | 28 |
| Line width (μm) | 247.94 | 181.81 | 272.97 | 195.51 | 291.03 | 181.92 | 368.27 | 170.45 |

The line width results show that the emulsion UV curable primer also provides more consistent line width and improves print quality.

The invention claimed is:

1. A process of ink jet printing comprising the steps of:

i) applying a radiation-curable primer to a substrate to form a layer of primer, ii) ink jet printing a radiation-curable ink onto the primer layer, and iii) curing the primer and the ink, wherein the viscosity of the primer increases after application to the substrate and the primer is heated before being applied to the substrate.

2. The process as claimed in claim 1 in which the substrate is a porous substrate.

3. The process as claimed in claim 1 in which the primer and the ink are cured simultaneously.

4. The process as claimed in claim 1 in which the primer is UV-curable, and is cured by UV radiation.

5. The process as claimed in claim 1 in which the primer is electron beam curable, and is cured by electron beam radiation.

6. The process as claimed in claim 1 in which the viscosity of the primer immediately prior to application to the substrate is less than 50 mPas.

7. The process as claimed in claim 1 in which the viscosity of the primer in the primer layer immediately before the ink jet printing is at least 100 mPas.

8. The process as claimed in claim 1 in which the viscosity of the primer in the primer layer immediately before the ink jet printing is greater than 1000 mPas.

9. The process as claimed in claim 1 in which the primer contains a wax.

10. The process as claimed in claim 9 in which the primer comprises in the range of from 5 to 10% by weight of the wax.

11. The process as claimed in claim 1 in which the primer is an oil-in-water emulsion.

12. The process as claimed in claim 11 in which the primer contains no more than 75% by weight of water.

13. The process as claimed in claim 1 in which the primer does not comprise a colourant.

14. The process as claimed in claim 1 in which the substrate is paper or cardboard.

15. The process as claimed in claim 1 in which the substrate is an uncoated substrate.

16. The process as claimed in claim 1 in which primer is applied to the substrate by either a brush, or a roller, or a knife, or by spraying.

17. The process as claimed in claim 1 in which the layer of primer is in the range of from 1 μm to 15 μm thick.

18. A printed article comprising a substrate having a layer of cured radiation-curable primer on at least one surface and, on the layer of cured primer, an image formed of cured jet ink, the article having been prepared by the process of claim 1.

19. The printed article as claimed in claim 18 which is a cardboard box or a blank for a cardboard box.

* * * * *